US007444904B2

(12) United States Patent
Huang

(10) Patent No.: US 7,444,904 B2
(45) Date of Patent: Nov. 4, 2008

(54) RATCHET MECHANISM FOR RATCHET TOOL

(76) Inventor: Ping-Chung Huang, No.2, Lane 235, Yongyi Rd., Taiping City, Taichung County 411 (TW)

( * ) Notice: Subject to any disclaimer, the term of this patent is extended or adjusted under 35 U.S.C. 154(b) by 0 days.

(21) Appl. No.: 11/717,632

(22) Filed: Mar. 14, 2007

(65) Prior Publication Data

US 2008/0223180 A1 Sep. 18, 2008

(51) Int. Cl.
*B25B 13/46* (2006.01)

(52) U.S. Cl. ..... 81/63.2; 192/43.2

(58) Field of Classification Search ..... 81/61–63.2; 192/43, 43.1, 43.2
See application file for complete search history.

(56) References Cited

U.S. PATENT DOCUMENTS 5,794,496 A * 8/1998 Arnold ..... 81/63.2
6,516,691 B1 * 2/2003 Wei ..... 81/63.2
7,017,453 B2 * 3/2006 Hu ..... 81/63.2
2003/0019334 A1 * 1/2003 Wei ..... 81/63.1
2003/0070512 A1 * 4/2003 Hu ..... 81/63.2

* cited by examiner

*Primary Examiner*—D. S Meislin
(74) *Attorney, Agent, or Firm*—Rosenberg, Klein & Lee

(57) ABSTRACT

A ratchet mechanism for a ratchet tool includes a pawl received in a recess of the head and biased by a bead which is biased by a spring received in a notch defined in an inner periphery of the recess. The pawl has a toothed surface which is matched with outer threaded surface of a driving wheel which is rotatably received in a through hole of the head. A receiving hole is defined through the pawl and opens a top surface of the pawl. A peripheral groove is defined radially outward in an inner periphery of the receiving hole. A shift member has a top board and a rod which extends from an underside of the top board, a stop is connected to a distal end of the rod. The stop and the rod are inserted into the receiving hole and the stop is movably engaged with the peripheral groove.

4 Claims, 5 Drawing Sheets

RATCHET MECHANISM FOR RATCHET TOOL

FIELD OF THE INVENTION

The present invention relates to a ratchet tool wherein the parts of the ratchet mechanism and the shift member are easily assembled.

BACKGROUND OF THE INVENTION

A conventional ratchet tool 9 is shown in FIG. 6 and generally includes a handle 91 and a head which is connected to an end of the handle 91. A through hole 913 is defined through the head and a recess 912 is defined in an inner periphery of the through hole 913, a notch 911 is defined in an inner periphery of the recess 811 so that the recess 912 communicates between the through hole 913 and the notch 911. When assembling the ratchet tool 9, the biasing unit 97 is first installed in the notch 911 and includes a spring 972 and a bead 971 which is biased by the spring 972 and partially protrudes into the recess 912. A pawl 95 is then inserted into the recess 912 and includes two concavities 951 on a first side thereof, the bead 971 is engaged with one of the two concavities 951. A driving wheel 92 is located in the through hole 913 and positioned by a collar 93 and a C-shaped clip 94. The pawl 95 has a toothed surface defined in a second side thereof so as to be matched with the outer threads of the driving wheel 92. A shift member 96 has an insertion 961 extending from an underside thereof and the insertion 961 is inserted into the positioning hole 952 of the pawl 95. The shift member 96 is received in a recessed area 914 defined in a side of the handle 91 and a top surface of the shift member 96 is in flush with the side of the handle 91. The shift member 96 includes a flange 962 which has to be forced fitted into a groove defined in an outer periphery of the collar 93. The shift member 96 can be shifted within the recessed area 914 to pivot the pawl 95 to set the effective direction to output torque when rotating the handle 91 of the ratchet wrench 9. When force-fitting the flange 962 into the groove in the collar 93, the shift member 96 might be deformed or even broken, and the assembling time required will be prolonged.

The present invention intends to provide a ratchet wrench wherein the parts are easily assembled without using too much force and the parts can be maintained in good condition.

SUMMARY OF THE INVENTION

The present invention relates to a ratchet tool and the ratchet tool comprises a head with a handle extending from the head. A through hole is defined through the head and a recess is defined in an inner periphery of the through hole. A notch is defined in an inner periphery of the recess which communicates between the through hole and the notch. A slot is defined in a side of the head and communicates with the recess. A spring is received in the notch and a bead is biased by the spring. A pawl is received the recess and includes two inclined surfaces defined in a first side thereof. The bead is engaged with one of the two inclined surfaces. A toothed surface is defined in a second side of the pawl. A driving wheel is received in the through hole and positioned by a C-shaped clip. The driving wheel has an outer threaded surface which is engaged with the toothed surface of the pawl. A receiving hole is defined through the pawl and opens a top surface of the pawl. A peripheral groove is defined radially outward in an inner periphery of the receiving hole. A shift member has a top board and a rod which extends from an underside of the top board. A stop is connected to a distal end of the rod. The stop and the rod are inserted into the receiving hole and the stop is movably engaged with the peripheral groove.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
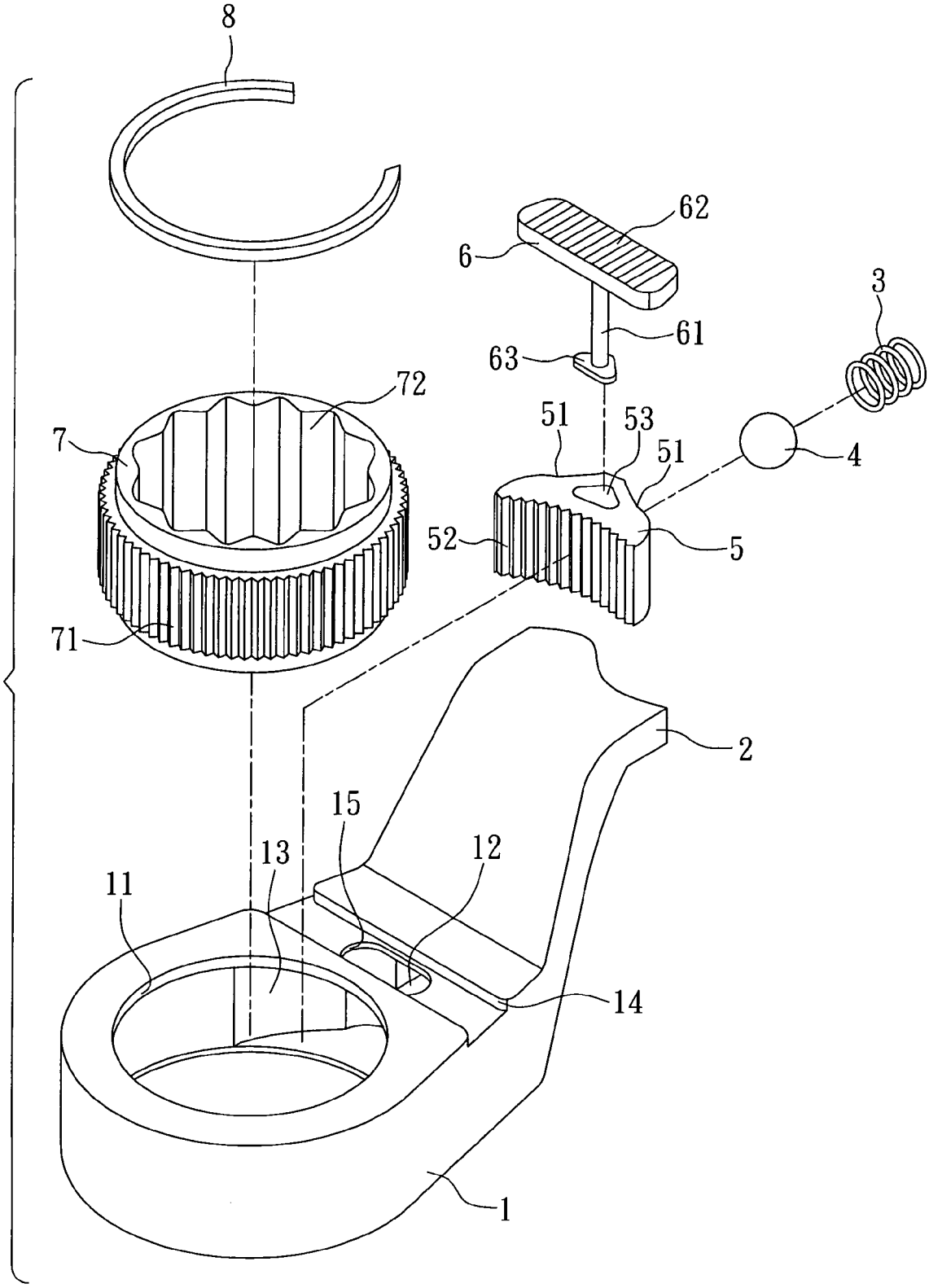
FIG. 1 is an exploded view to show the ratchet wrench of the present invention.
Figure 2:
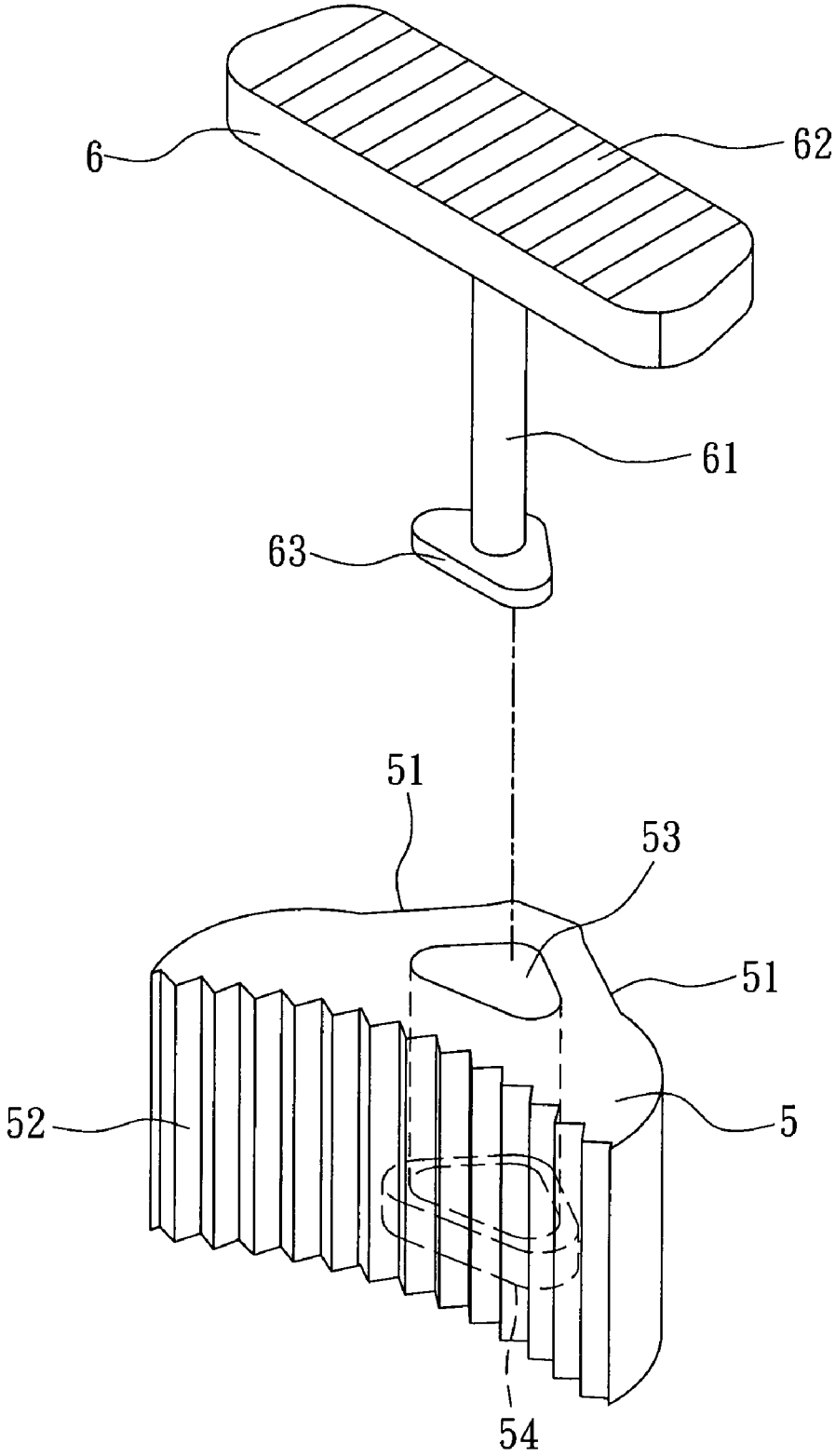
FIG. 2 shows the shift member and the pawl of the ratchet wrench of the present invention.
Figure 3:
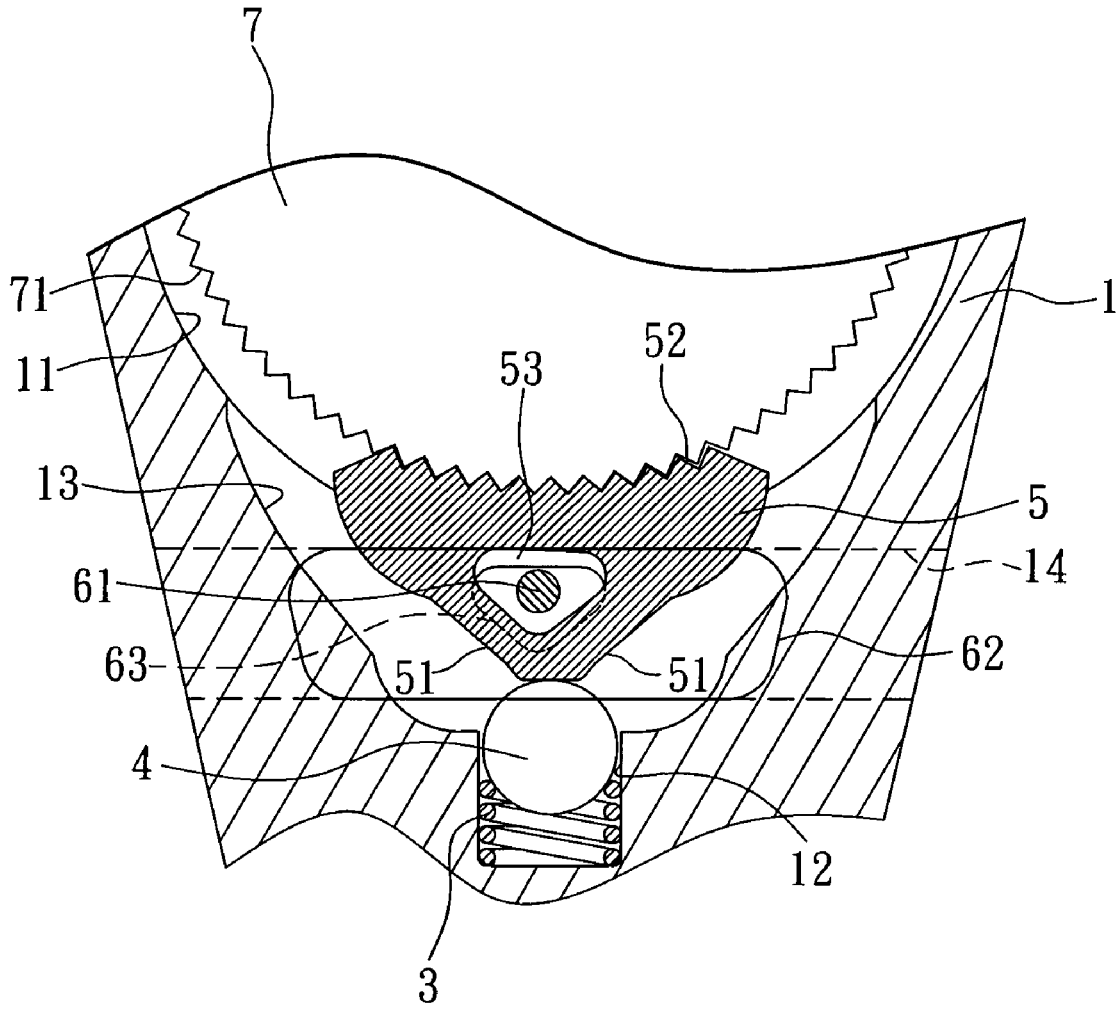
FIG. 3 shows that the bead contacts at the protrusion of the pawl.

Referring to FIGS. 1 to 3, the ratchet tool of the present invention comprises a head 1 and a handle 2 extends from the head 1. A through hole 11 is defined through the head 1 and a recess 13 is defined in an inner periphery of the through hole 11. A notch 12 is defined in an inner periphery of the recess 13 which communicates between the through hole 11 and the notch 12. An elongate recessed area 14 is defined in a side of the head 1 and an axis of the elongate recessed area 14 is perpendicular to an axis of the handle 2. A slot 15 is defined in an inner end of the recessed area 14 and communicates with the recess 13.

A spring 3 is received in the notch 12 and a bead 4 is biased by the spring 3 and partially protrudes in the recess 13. A pawl 5 is received the recess 13 and includes two inclined surfaces 51 defined in a first side thereof. A protrusion extends from the first side of the pawl 5 and is located between the two inclined surfaces 51. The bead 4 is engaged with one of the two inclined surfaces 51 when operating the ratchet wrench. A toothed surface 71 is defined in a second side of the pawl 5. A receiving hole 53 is defined through the pawl 5 and opens a top surface of the pawl 5. A peripheral groove 54 is defined radially outward in an inner periphery of the receiving hole 53.

A driving wheel 7 is received in the through hole 11 and positioned by a C-shaped clip 8. The driving wheel 7 has an outer threaded surface 71 which is engaged with the toothed surface 71 of the pawl 5. A polygonal inner periphery 72 is defined in the hole defined through the driving wheel 7 so that an object (not shown) can be engaged with the polygonal inner periphery 72.

A shift member 6 has a top board 62 and a rod 61 which extends from an underside of the top board 62. A stop 63 is connected to a distal end of the rod 61 and the stop 63 is a triangular plate. The stop 63 and the rod 61 are inserted into the receiving hole 53 and the stop 63 is movably engaged with the peripheral groove 54 so as to prevent the shift member 6 is not disengaged from the receiving hole 53 of the pawl 5. The top board 62 is slidably engaged with the elongate recessed area 14. It is noted that a size of the receiving hole 53 is larger than a diameter of the rod 61 so that the rod 61 can be moved in the receiving hole 53.

Figure 4:
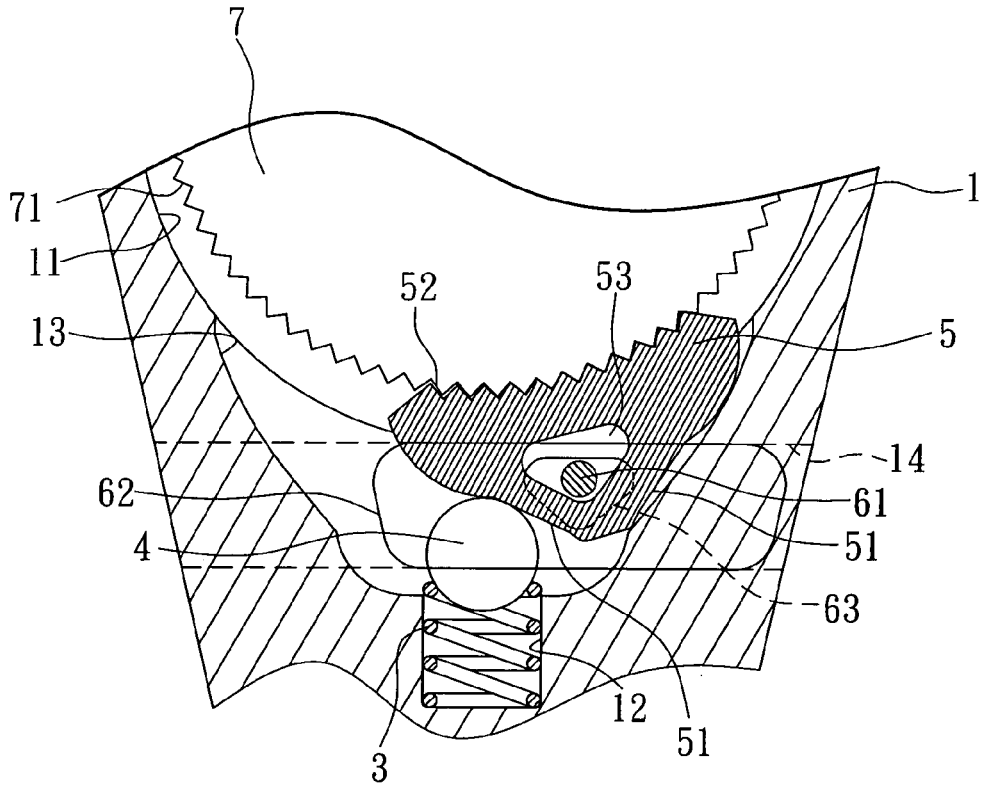
FIG. 4 shows that the shift member is shifted to right and the bead contacts one of the inclined surfaces of the pawl.
Figure 5:
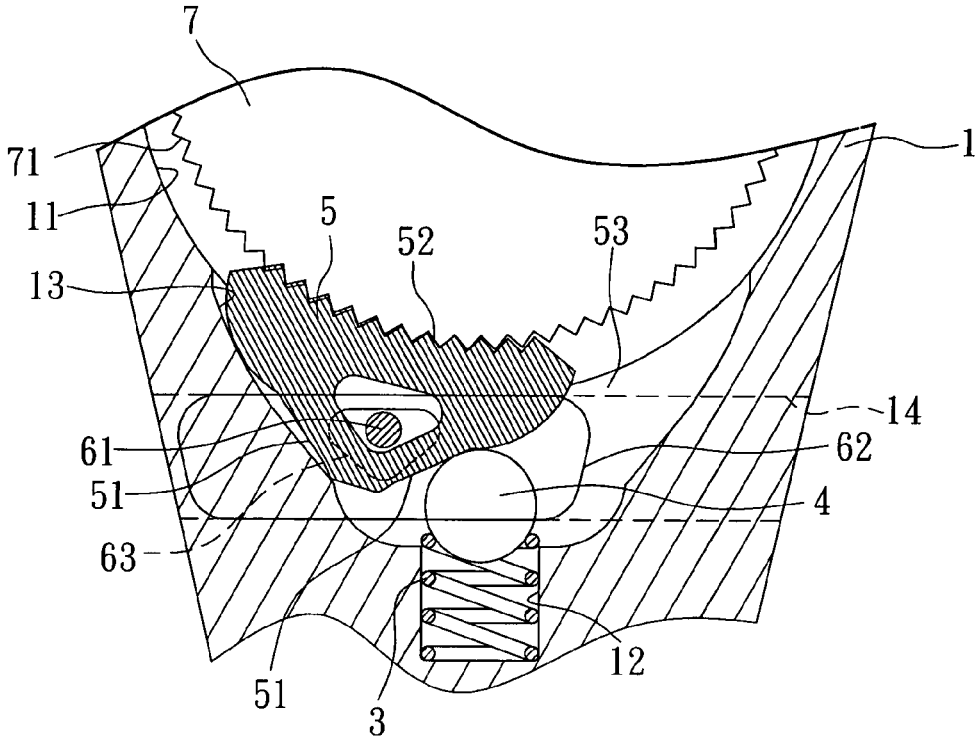
FIG. 5 shows that the shift member is shifted to left and the bead contacts the other one of the inclined surfaces of the pawl.
Figure 6:
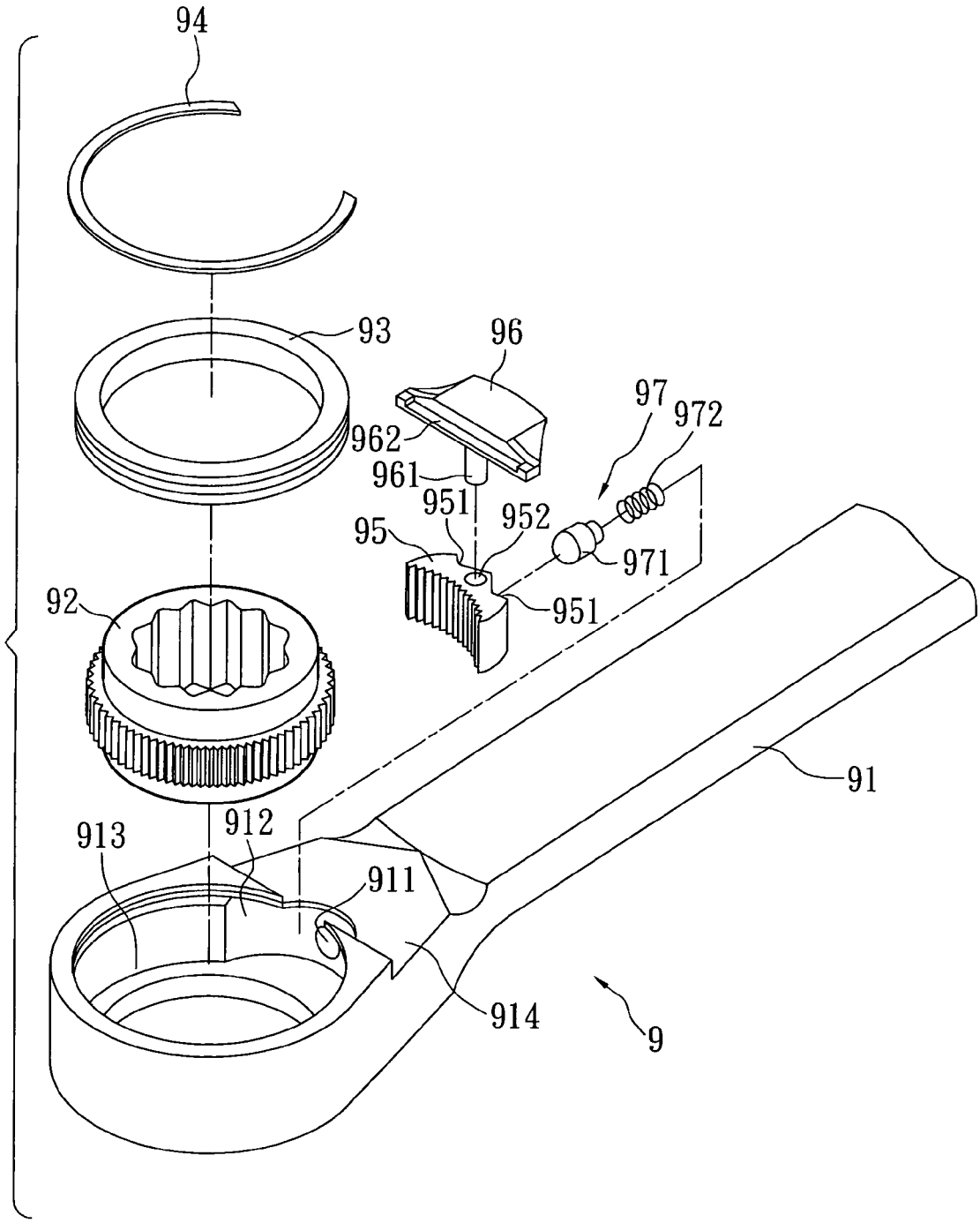
FIG. 6 PRIOR ART
FIG. 6 is an exploded view to show the conventional ratchet wrench.

As shown in FIGS. 4 and 5, when using the ratchet wrench, the shift member 6 is shifted toward right or left by pushing the serrated surface of the top board 62 and the pawl 5 is moved by the shift of the shift member 5. The bead 4 then urges one of the tow inclined surfaces 61 and the other inclined surface 51 contacts against the inner side of the recess 13 so that the driving wheel 7 can be rotated together with the rotation of the handle 2 to tighten or loosen the object.

During assembling, the spring 3, the bead 4, the pawl 5, the driving wheel 7, the C-shaped clip 8, and the shift member 6 are installed in sequence respectively. The stop 63 are slightly pushed to be fitted into the peripheral groove 54. None of the parts is deformed or applied by severe stress, and the assembly can be done within a short period of time.

While we have shown and described the embodiment in accordance with the present invention, it should be clear to those skilled in the art that further embodiments may be made without departing from the scope of the present invention.

What is claimed is:

1. A ratchet tool comprising:

a head and a handle extending from the head, a through hole defined through the head and a recess defined in an inner periphery of the through hole, a notch defined in an inner periphery of the recess, the recess communicating between the through hole and the notch, a slot defined in a side of the head and communicating with the recess;

a spring received in the notch and a bead biased by the spring and partially protruding in the recess;

a pawl received in the recess and including two inclined surfaces defined in a first side thereof, a protrusion extending from the first side of the pawl and located between the two inclined surfaces, the bead being engaged with one of the two inclined surfaces, a toothed surface defined in a second side of the pawl, a receiving hole defined through the pawl from and opening at a top surface of the pawl, a peripheral groove defined to extend radially outward from the receiving hole at an inner peripheral surface of the pawl, the peripheral groove forming a polygonal contour about the receiving hole;

a driving wheel received in the through hole and positioned by a C-shaped clip, the driving wheel having an outer toothed surface which is engaged with the toothed surface of the pawl, and a shift member having a top board and a rod extending from an underside of the top board, a stop corresponding to the peripheral groove in polygonal contour connected to a distal end of the rod, the stop and the rod being inserted into the receiving hole and the stop movably engaged with the peripheral groove to be retained therein, the rod remaining cleared from contact with a surrounding surface of the pawl within the receiving hole.

2. The ratchet wrench as claimed in claim 1, wherein a size of the receiving hole is larger than a diameter of the rod.

3. The ratchet wrench as claimed in claim 1, wherein the stop is a triangular plate.

4. The ratchet wrench as claimed in claim 1, wherein an elongate recessed area defined in a side of the head and the slot defined in an inner end of the recessed area, an axis of the elongate recessed area is perpendicular to an axis of the handle, the top board is slidably engaged with the elongate recessed area.

* * * * *